US005669089A

United States Patent [19]

Dees

[11] Patent Number: 5,669,089

[45] Date of Patent: Sep. 23, 1997

[54] PLEATED WORK MAT WITH INTEGRAL HEADREST

[76] Inventor: Kent L. Dees, 8385 Lake Ben Ave., San Diego, Calif. 92119

[21] Appl. No.: 550,250

[22] Filed: Oct. 6, 1995

[51] Int. Cl.[6] ..... B25H 5/00

[52] U.S. Cl. ..... 5/419; 5/417; 5/722; 5/656; 5/657

[58] Field of Search ..... 5/417, 419, 420, 5/465, 625, 722, 656, 657

[56] References Cited

U.S. PATENT DOCUMENTS

| | | | |
|---|---|---|---|
| 1,356,593 | 10/1920 | Bettiker | 5/420 |
| 4,815,155 | 3/1989 | Somners | 5/417 |
| 4,868,940 | 9/1989 | Masadi | 5/417 |
| 4,926,512 | 5/1990 | Coyle | 5/924 |
| 4,985,952 | 1/1991 | Edelson | 5/420 |
| 5,020,854 | 6/1991 | Powell | 5/419 |
| 5,066,001 | 11/1991 | Wilkinson | 5/420 |

*Primary Examiner*—Steven N. Meyers
*Assistant Examiner*—Fredrick Conley
*Attorney, Agent, or Firm*—John L. Rogitz

[57] ABSTRACT

A cardboard work mat has a pleated configuration, wherein the mat is folded in pleats for storage, and an unfolded configuration, wherein the mat defines a surface area sufficiently large for supporting a mechanic beneath a vehicle. A headrest is formed on one end of the mat by folding the two or three end-most pleats together and then bonding them together. In an alternate embodiment, the mat is a flexible plastic sheet which has a rolled configuration for storage and an unrolled configuration for supporting a mechanic on the sheet. A headrest is molded or attached to one end of the sheet.

5 Claims, 3 Drawing Sheets

PLEATED WORK MAT WITH INTEGRAL HEADREST

FIELD OF THE INVENTION

The present invention relates generally to mechanic's accessories, and more particularly to support structures on which mechanics can lay supine beneath a vehicle or otherwise lay or kneel on while performing maintenance.

BACKGROUND

Automotive creepers have been provided for supporting a mechanic in a supine position beneath a vehicle while the mechanic performs maintenance on the vehicle. During maintenance, the platform of a typical creeper is not disposed on the ground, but is supported by wheels or casters, to facilitate positioning the creeper in the desired location beneath the vehicle, as disclosed in, e.g., U.S. Pat. No. 5,195,763 to Scott et al. Consequently, the platform of most creepers must be rigid, to impart sufficient strength to the platform for supporting the mechanic above the ground.

Accordingly, while effective for their intended purpose, creepers require the use of comparatively large, rigid platforms which can be relatively expensive to make and which are cumbersome, heavy, and bulky to store. Further, the rigidity of many creeper platforms tends to make them uncomfortable to lay on for prolonged periods. Still further, owing to their relatively high expense, most creepers are generally unsuitable for disposable use. The present invention recognizes, however, that an inexpensive, effective work mat can be provided which is both comfortable, lightweight, and easy to store, and which can be made of inexpensive recyclable materials.

It is therefore an object of the present invention to provide a work mat which is effective and comfortable, and more particularly which includes means for supporting a person's head while laying supine beneath a vehicle. Another object of the present invention is to provide a mechanic's mat which can be easily stored in a compact location. Still another object of the present invention is to provide a mechanic's mat which is easy to use and cost-effective to manufacture.

SUMMARY OF THE INVENTION

A work mat includes a pad that is manually movable between an unfolded configuration, wherein the pad is substantially flat such that a person can lie supine on the pad beneath a vehicle, and a pleated configuration, wherein the pad is pleated to facilitate storing the pad. A head rest is attached to the pad at one end thereof to support the head of a person when the person lies supine on the pad.

Preferably, the pad includes a plurality of panels and a plurality of hinge joints. In accordance with the present invention, a respective hinge joint is positioned between adjacent panels to facilitate folding the mat into the pleated configuration. In the presently preferred embodiment, the pad is made of cardboard, and each hinge joint is a living joint that is established by score lines formed between adjacent panels. Alternatively, the pad can be made of scribed plastic. As envisioned by the preferred embodiment, the head rest is established by at least two panels that are bonded flushly together at one end of the pad.

In an alternate embodiment, the hinge joints are mechanical joints which include interlocking U-shaped members. In yet another alternate embodiment, the pad is a plastic flexible pad which is movable between an unrolled configuration, wherein the pad is substantially flat, and a rolled configuration, wherein the pad is rolled to facilitate storing the pad.

In another aspect of the present invention, a cardboard mechanic's mat for supporting a person beneath a vehicle is disclosed. As discussed in further detail below, the mat includes an elongated, generally parallelepiped-shaped cardboard pad that is transversely scored to establish a plurality of panels. Consequently, each panel is hingedly engaged with its contiguous panels such that the pad is movable between an unfolded configuration, wherein the panels are substantially co-planar with each other, and a pleated configuration, wherein the panels are pleatedly folded against each other. A head rest is positioned on one end of the pad, and the head rest is established by bonding at least two panels flush together.

In yet another aspect of the present invention, an elongated cardboard mechanic's pad has transverse score lines formed thereon and spaced apart about four inches to eight inches. Consequently, the pad can be easily pleated for storage. Also, the pad has a head rest for supporting the head of a person lying supine on the pad when the pad is not pleated.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
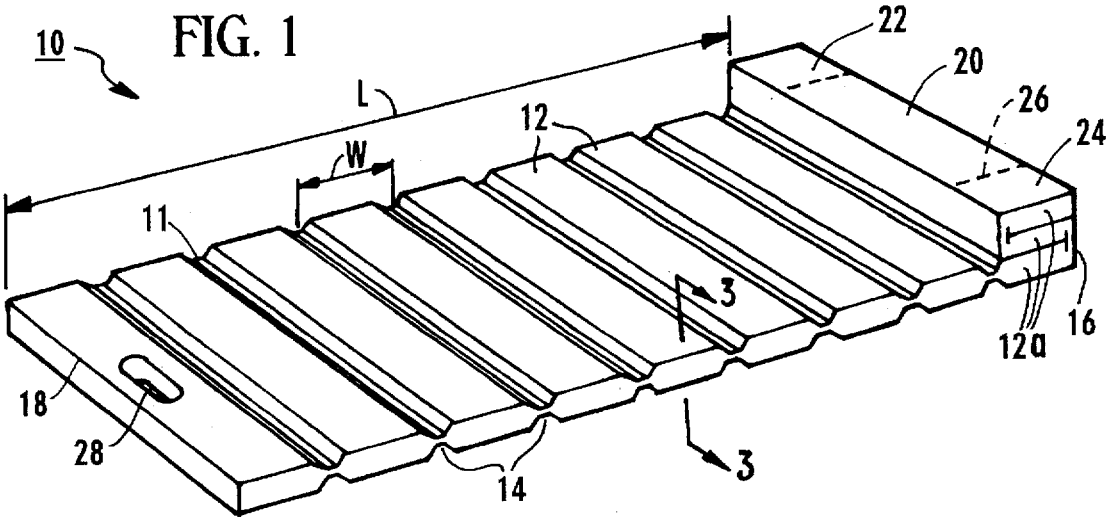
FIG. 1 is a perspective view of the pleated work mat of the present invention, showing the mat in the unfolded configuration.

Referring initially to FIG. 1, a work mat is shown, generally designated 10, in an unfolded configuration. It will readily be appreciated in reference to FIG. 1 that a person (not shown) can position the mat 10 beneath a vehicle (not shown) and then lie supine on the mat 10 to facilitate maintenance on the vehicle.

In accordance with the present invention, the mat 10 includes a body pad 11 made of an inexpensive material, preferably cardboard, which can be formed in the elongated, parallelepiped-shaped configuration shown by means well-known in the art. Alternatively, the pad 11 can be made of plastic, such as polypropylene or vinyl.

In accordance with the present invention, the pad 11 includes a plurality of panels 12 which are substantially co-planar with each other in the unfolded configuration shown in FIG. 1 to thereby render the pad 11 substantially flat throughout its length "L". Preferably, each panel 12 defines a width "W" of about two to eight inches (2"–8"), and more preferably about six inches (6"). As recognized by the present invention, the panels 12 can accordingly be relatively narrow despite being made of cardboard, because the panels 12 are positioned flush against the ground in the unfolded configuration when supporting a person, and consequently need not be sufficiently strong to support a person sitting against the panels 12 in an upright sitting position.

A respective one of a plurality of living hinge joints 14 is formed between adjacent panels 12 by means well-known in the art, e.g., by transversely scoring the pad 11 of the mat 10 to establish the joints 14 when the pad is made of cardboard, or by scribing a pad that is made of plastic. It is to be understood that a panel 12 can be hingedly folded relative to one of its immediately adjacent panels 12 about the joint 14 which is positioned therebetween. Thus, as intended by the present invention, "scored" means weakening the cardboard pad 11 along the hinge joints. 14 by means well-known in the art to permit folding the pad 11 along the hinge joints 14.

Figure 1A:
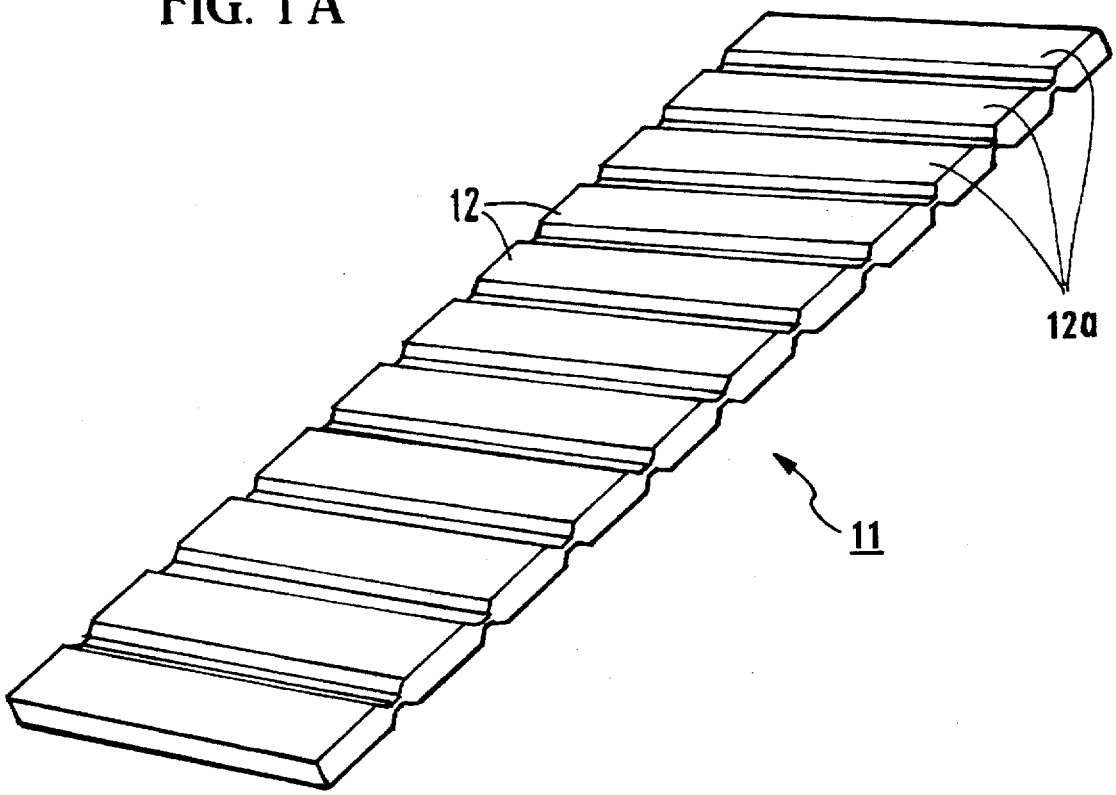
FIG. 1A is a perspective view of the work mat prior to establishing the head rest.

As shown in FIG. 1, the mat 10 defines a head end 16 and a foot end 18. In brief cross-reference to FIGS. 1 and 1A, the three panels 12*a* that are adjacent the head end 16 are folded in pleats against each other and then bonded or stapled in the configuration shown to permanently establish a padded head rest 20 which is elevated relative to the panels 12 which are not part of the head rest 20. By "permanently establish" is meant that panels 12*a* which establish the head rest 20 cannot easily be separated from each other. If desired, ends 22, 24 of the head rest 20 can be removed from the mat 10 as indicated along the dotted lines 26 in FIG. 1 as by, e.g., chopping the ends 22, 24 by means well-known in the art.

Alternatively, the head rest 20 can be made separately from the panels 12, and then bonded to the panels 12. For example, the head rest 20 can be made of cardboard or of an air-inflatable plastic material and then bonded to the panels 12. In either case, a hand opening 28 preferably is cut into the mat 10 near the foot end 18 to facilitate manually carrying the mat 10, or hanging the mat 10 on a wall.

Figure 2:
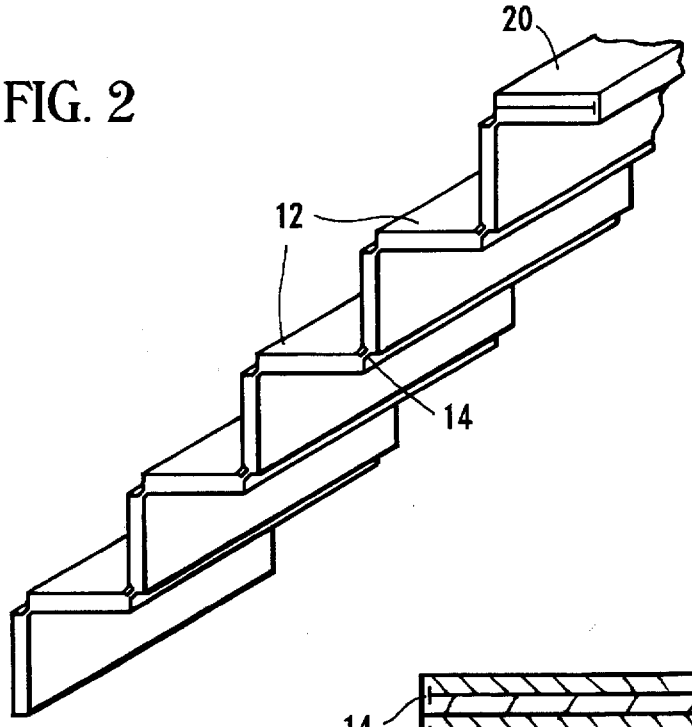
FIG. 2 is a perspective view of the mat intermediate the unfolded configuration and pleated configuration, with portions broken away.
Figure 3:
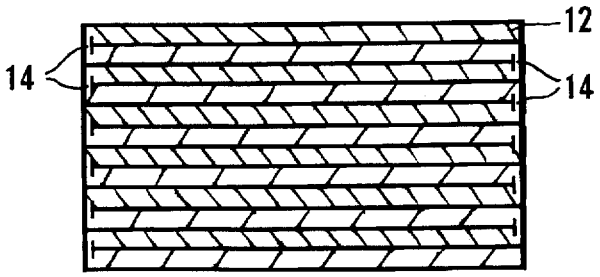
FIG. 3 is a cross-sectional view of the mat, as would be seen along the line 3—3 in FIG. 1 in the pleated configuration.

FIGS. 2 and 3 show that the mat 10 can be manually moved to a pleated configuration by hingedly pivoting the panels 12 relative to each other in a double fold (i.e., pleated) pattern about the joints 14. FIG. 3 best shows that in the fully pleated configuration, the panels 12 are folded flush against each other in a compact configuration to facilitate storage of the mat 10 in a relatively small space.

Figure 4:
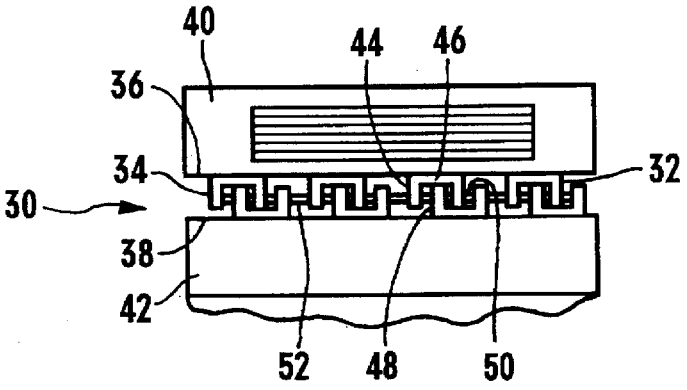
FIG. 4 is a top plan view of an alternate embodiment of the pleated mat, showing an interlocking joint structure between panels, with portions broken away.

FIG. 4 shows a work mat, generally designated 30, which is in all essential respects identical to the mat 10 shown in FIGS. 1–3, except that each living hinge 14 shown in FIGS. 1–3 has been replaced by a respective mechanical hinge 32. Specifically, each mechanical hinge 32 includes a plurality of U-shaped members 34, each of which is bonded or otherwise attached to a first or second edge 36, 38 of adjacent first and second panels 40, 42 and interlocked with an associated opposed U-shaped member 34.

More specifically, each U-shaped member 34 on the first edge 36 includes two first arms 44 which establish a first trough 46 therebetween, while each U-shaped member 34 on the second edge 38 includes two second arms 48 which establish a second trough 50 therebetween. One of the first arms 44 of each U-shaped member 34 on the first edge 36 is disposed in a second trough 50 of a U-shaped member 34 on the second edge 38. Likewise, one of the second arms 48 of each U-shaped member 34 on the second edge 38 is disposed in the first trough 46 of a U-shaped member 34 on the first edge 36. An elongated cylindrical pin 52 is inserted through the arms 44, 48 of the U-shaped members 34 to pivotably hold the members 34 in the hinged connection shown.

Figure 5:
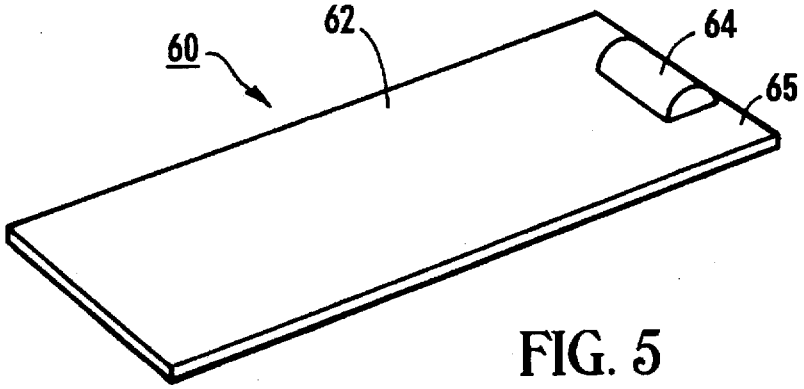
FIG. 5 is a perspective view of still another alternate embodiment of the present invention, showing a rollable plastic mat in the unrolled configuration.
Figure 6:
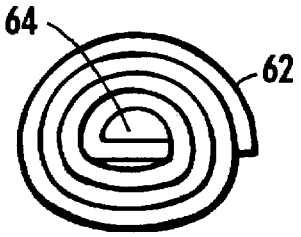
FIG. 6 is a side plan view of the mat shown in FIG. 5, in the rolled configuration.

FIGS. 4 and 5 show a mat, generally designated 60, which is made of a single parallelepiped-shaped pad 62 of flexible plastic material, e.g., Teflon® vinyl. As shown, the mat 60 includes a padded foam or plastic inflatable resilient head rest 64 that is formed integrally with or bonded to the pad 62 near a head end 65 of the pad 62. As intended by the present invention, the mat 60 can assume a flat unrolled configuration (FIG. 4) for supporting a person on the pad 62 beneath a vehicle. As further intended by the present invention, the mat 60 can assume a rolled configuration (FIG. 5) to facilitate storing the mat 60 in a relatively small space.

While the particular work mat as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

I claim:

1. A work mat, comprising:

a pad having a plurality of panels manually movable between an unfolded configuration, wherein the pad is substantially flat such that a person can lie supine on the pad beneath a vehicle, and a pleated configuration, wherein the pad is pleated to facilitate storage of the pad, wherein one of the panels is a head rest defining a first flat surface and another of the panels is an end panel defining a second flat surface, wherein the first flat surface is substantially permanently bonded flush against the second flat surface to support the head of a person when the person lies supine thereon.

2. The mat of claim 1, wherein the pad includes a plurality of panels and a plurality of hinge joints, wherein a respective hinge joint is positioned between adjacent panels to facilitate moving the mat to the pleated configuration.

3. The mat of claim 2, wherein each hinge joint is a living joint.

4. The mat of claim 3, wherein the pad is made of cardboard, and each hinge joint is established by score lines formed between adjacent panels.

5. The mat of claim 2, wherein each hinge joint is a mechanical joint including interlocking members.

* * * * *